US010905966B2

(12) United States Patent
Sisamos

(10) Patent No.: US 10,905,966 B2
(45) Date of Patent: Feb. 2, 2021

(54) SNAP-LOCK CONSTRUCTION TOY PLATFORM

(71) Applicant: Costas Sisamos, Limassol (CY)

(72) Inventor: Costas Sisamos, Limassol (CY)

( * ) Notice: Subject to any disclaimer, the term of this patent is extended or adjusted under 35 U.S.C. 154(b) by 0 days.

(21) Appl. No.: 16/794,078

(22) Filed: Feb. 18, 2020

(65) Prior Publication Data

US 2020/0261819 A1 Aug. 20, 2020

Related U.S. Application Data

(60) Provisional application No. 62/806,249, filed on Feb. 15, 2019.

(51) Int. Cl.
*A63H 33/06* (2006.01)

(52) U.S. Cl.
CPC ..... *A63H 33/062* (2013.01)

(58) Field of Classification Search
CPC .... A63H 33/00; A63H 33/101; A63H 33/062; A63H 33/086; A63H 33/088; A63H 33/105; A63H 33/107; A63H 33/04; E04B 1/1903; E04B 1/2403
USPC ..... 446/120–128, 85, 105, 107
See application file for complete search history.

(56) References Cited

U.S. PATENT DOCUMENTS 5,704,186 A * 1/1998 Alcalay ..... A63H 33/062 52/848
6,736,691 B1 * 5/2004 Bach ..... A63H 33/101 446/128
7,517,270 B2 * 4/2009 Marzetta ..... A63H 33/101 446/113
8,651,914 B2 * 2/2014 Sisamos ..... A63H 33/101 446/120
2007/0123137 A1 * 5/2007 Marzetta ..... A63H 33/105 446/120
2014/0273712 A1 * 9/2014 Uttley ..... A63H 33/107 446/121

OTHER PUBLICATIONS

U.S. Appl. No. 29/721,603, filed Jan. 22, 2020.
U.S. Appl. No. 29/721,621, filed Jan. 22, 2020.
U.S. Appl. No. 29/721,602, filed Jan. 22, 2020.
(Continued)

*Primary Examiner* — Kien T Nguyen
(74) *Attorney, Agent, or Firm* — Eschweiler & Potashnik, LLC

(57) ABSTRACT

A snap-lock toy system has a receiving member with a thru-hole and a rod member having an engagement portion. The engagement portion selectively mates with the thru-hole and has a pair of cantilever members separated by a gap, each having a hole engagement rib to resiliently compress the first cantilever members to resiliently move the cantilever members concurrent with entering and exiting opposing ends of the thru-hole and selectively coupling the rod member to the receiving member by a friction interface. A locking member has an interface portion with a locking rib configured to selectively mate with the cantilever members. The locking rib resiliently compresses upon insertion of the locking rib between the cantilever members and decompresses when the locking rib engages an internal groove of the cantilever members to selectively prevent decoupling of the rod member from the receiving member.

20 Claims, 8 Drawing Sheets

(56) References Cited

OTHER PUBLICATIONS

U.S. Appl. No. 29/721,600, filed Jan. 22, 2020.
U.S. Appl. No. 29/721,720, filed Jan. 22, 2020.
U.S. Appl. No. 29/721,641, filed Jan. 22, 2020.
U.S. Appl. No. 29/721,605, filed Jan. 22, 2020.

* cited by examiner

SNAP-LOCK CONSTRUCTION TOY PLATFORM

REFERENCE TO RELATED APPLICATIONS

This application claims the benefit of U.S. Provisional Application No. 62/806,249 filed Feb. 15, 2019, entitled "CONSTRUCTION TOY ROBOTIC PLATFORM", the contents of which are herein incorporated by reference in their entirety.

FIELD

The present disclosure relates generally to construction toys, systems, and methods, and more particularly to construction toys having variously-shaped components that are removably connectable utilizing male and female connectors.

BACKGROUND

Construction toys have been developed over the years for play, education, and industry modeling. In particular, various injection molded construction toy building blocks have been introduced, where individual blocks are stacked atop one another to form various creations.

Conventional construction toys have components that are three dimensional, however they are limited in their angular orientation, as well as being limited in angled connection of components. Further, male and female connector portions are generally smooth and are held together with friction, resulting in reduced stability and ultimately abrasive wear on components.

Various others have attempted to overcome some of the limitations of such designs with various levels of success. There continues to be a need for multi-functional construction toys with multi-faceted and multi-angular connectable components. There also continues to be a need for reusable connector portions that lock into position and provide greater stability while being simple to use.

SUMMARY

The present disclosure provides a construction toy that utilizes snap-lock technology in an innovative manner. Accordingly, the following presents a simplified summary of the disclosure in order to provide a basic understanding of some aspects of the invention. This summary is not an extensive overview of the invention. It is intended to neither identify key or critical elements of the invention nor delineate the scope of the invention. Its purpose is to present some concepts of the invention in a simplified form as a prelude to the more detailed description that is presented later.

In accordance with one aspect of the disclosure, a snap-lock toy system is provided, wherein the snap-lock toy comprises a plurality of snap-lock toy members. In one example, the snap-lock toy system comprises a receiving member comprising a thru-hole extending along a first axis between first and second hole ends of the receiving member. The thru-hole, for example, defines a thru-hole dimension when viewed along the first axis.

A rod member, for example, extends along a second axis, wherein the rod member comprises an engagement portion configured to selectively mate with the thru-hole. The engagement portion, for example, generally defines an engagement dimension when viewed along the second axis, wherein the engagement dimension is less than or approximately equal to the thru-hole dimension. The thru-hole and engagement portion of the rod member, for example, can be one or more of circular, cross-shaped, or any other shape when viewed along the respective first and second axes.

In one example, the engagement portion comprises a first bifurcated portion extending from a first location along the second axis to a first end of the rod member. The first bifurcated portion, for example, comprises a pair of first cantilever members separated by a first gap defining a first gap dimension when viewed along the second axis. Each first cantilever member, for example, comprises a hole engagement rib extending outward relative to the second axis, therein defining an engagement rib dimension of the first bifurcated portion. The engagement rib dimension, for example, is greater than the thru-hole dimension, wherein the engagement rib is configured to resiliently compress the pair of first cantilever members toward one another concurrent with an insertion of the engagement portion into the first hole end of the thru-hole. The configuration of the hole engagement rib and thru-hole, for example, are further configured to resiliently decompress the pair of first cantilever members away from one another concurrent with the hole engagement rib exiting the second hole end of the thru-hole. As such, the rod member can be selectively coupled to the receiving member.

Each first cantilevered member, for example, further comprises an internal groove proximate to the first location, therein defining a groove dimension proximate to the first location when viewed along the second axis. The groove dimension, for example, is greater than the first gap dimension.

In another example, a locking member is provided and comprises a cap and an interface portion extending from the cap along a third axis. The interface portion, for example, is configured to selectively mate with the first bifurcated portion of the rod member, wherein the interface portion defines an interface dimension when viewed along the third axis that is less than or approximately equal to the first gap dimension.

The locking member, for example, further comprises a locking rib extending outward relative to the third axis from the interface portion proximate to a distal end of the interface portion, therein defining a locking rib dimension. The locking rib dimension, for example, is greater than the first gap dimension and less than or equal to the groove dimension, wherein the locking rib is configured to resiliently compress concurrent with an insertion of the locking rib into the first bifurcated portion of the rod member, and to resiliently decompress concurrent with the locking rib engaging the internal groove of the rod member. As such, a position (e.g., a radial position) of the pair of first cantilever members, for example, can be selectively fixed to substantially prevent decoupling of the rod member from the receiving member.

In another example, the interface portion of the locking member is bifurcated. In this example, the interface portion comprises a pair of second cantilever members separated by a second gap and defining a second gap dimension therebetween.

In yet another example, the engagement portion of the rod member is substantially cross-shaped when viewed along the second axis. The thru-hole, for example, can also be substantially cross-shaped when viewed along the first axis. As such, the selective mating of the engagement portion of the rod member with the thru-hole generally prevents a rotation of the rod member about the first axis while generally permitting a sliding engagement of the rod member along the first axis.

In another example, the thru-hole can be substantially circular when viewed along the first axis. As such, the selective mating of the engagement portion of the rod member with the thru-hole generally permits a rotation of the rod member about the first axis.

In yet another example, the cap generally defines a cap dimension, wherein the cap dimension is greater than the thru-hole dimension when viewed along the third axis.

An accessory member may be further provided, wherein, for example, the accessory member comprises an accessory hole defined along a fourth axis. The accessory hole, for example, can be configured to further selectively mate with the engagement portion of the rod member. The accessory member, for example, may comprise a wheel, gear, or other accessory.

In one example, the accessory hole can be substantially cross-shaped when viewed along the fourth axis, wherein when the thru-hole is substantially cross-shaped, the selective mating of the engagement portion of the rod member with the accessory hole generally prevents a rotation of the accessory member about the first axis while generally permitting a sliding engagement of the accessory member along the first axis.

In another example, the accessory hole can be substantially circular when viewed along the fourth axis, wherein the selective mating of the engagement portion of the rod member with the accessory hole generally permits a rotation of the accessory member about the first axis.

In still another example, the receiving member can further comprise one or more female receptors, wherein each female receptor comprises a polygonal wall defined around the thru-hole when viewed along the first axis. The one or more female receptors, for example, respectively extend outward from one or more of the first and second hole ends of the thru-hole by a respective one or more female receptor depths.

For example, the rod member can further comprise a polygonal feature generally surrounding the engagement portion when viewed along the second axis. The polygonal feature, for example, can be configured to selectively mate with the one or more female receptors of the receiving member, therein selectively locking a rotational position of the rod member with respect to the receiving member. The polygonal wall and polygonal feature, for example, can be substantially octagonal, thereby providing selective locking of the rotational position of the rod member with respect to the receiving member in 45-degree increments when viewed along to the first axis.

In another example, the receiving member can comprise a support structure, wherein the thru-hole and the one or more female receptors are recessed from the support structure when viewed perpendicular to the first axis. In one example, such a recessing of the thru-hole and the one or more female receptors generally permits flush mounting of various other components or members while permitting the rotational locking discussed above.

In yet another example, the receiving member can comprise any number of thru-holes in a myriad of configurations extending along a respective plurality of first axes. For example, the receiving member can comprise a straight beam, elbow beam, or any other beam having one, two, three, or more thru-holes defined therein, with any combination shapes of female receptors.

In accordance with another exemplified embodiment, a snap-lock toy system comprises a receiving member comprising a thru-hole along a first axis.

A rod member comprising an engagement portion along a second axis and configured to selectively mate with the thru-hole is provided, wherein the engagement portion comprises a pair of first cantilever members separated by a first gap. Each first cantilever member, for example, comprises a hole engagement rib configured to resiliently compress the pair of first cantilever members toward one another concurrent with an insertion of the engagement portion into a first hole end of the thru-hole and to resiliently decompress the pair of first cantilever members away from one another concurrent with exiting a second hole end of the thru-hole. Thus, the rod member, for example, is selectively coupled to the receiving member by a friction interface between the pair of first cantilever members and the thru-hole along the first and second axes.

Each first cantilevered member, for example, can further comprise an internal groove, wherein a locking member can be further provided for locking an axial position of the rod member with respect to the receiving member. The locking member, for example, comprises a cap and an interface portion along a third axis having a locking rib extending radially therefrom. The interface portion, for example, is configured to selectively mate with the pair of first cantilever members, wherein the locking rib is configured to resiliently compress concurrent with an insertion of the locking rib between the pair of first cantilever members, and to resiliently decompress concurrent with the locking rib engaging the internal groove. Thus, a radial position of the pair of first cantilever members and the hole engagement rib is selectively fixed to substantially prevent decoupling of the rod member from the receiving member along the first, second, and third axes.

The interface portion of the locking member, for example, can again be bifurcated, wherein the interface portion comprises a pair of second cantilever members separated by a second gap. The engagement portion of the rod member can be substantially cross-shaped when viewed along the second axis.

The thru-hole, for example, can be substantially cross-shaped when viewed along the first axis, wherein the selective mating of the engagement portion of the rod member with the thru-hole generally prevents a rotation of the rod member about the first axis while generally permitting a sliding engagement of the rod member along the first axis. The thru-hole, for example, can further be substantially circular when viewed along the first axis, wherein the selective mating of the engagement portion of the rod member with the thru-hole generally permits a rotation of the rod member about the first axis.

In yet another example, the receiving member can further comprise one or more female receptors, wherein each female receptor comprises a polygonal wall defined around the thru-hole when viewed along the first axis. The one or more female receptors, for example, respectively extend outward from one or more of the first and second hole ends of the thru-hole. The rod member, for example, can further comprise a polygonal feature generally surrounding the engagement portion when viewed along the second axis, wherein the polygonal feature is configured to selectively mate with the one or more female receptors of the receiving member, therein selectively locking a rotational position of the rod member with respect to the receiving member.

To the accomplishment of the foregoing and related ends, the disclosure comprises the features hereinafter fully described and particularly pointed out in the claims. The following description and the annexed drawings set forth in detail certain illustrative embodiments of the invention. These embodiments are indicative, however, of a few of the various ways in which the principles of the invention may be employed. Other objects, advantages and novel features of the invention will become apparent from the following detailed description of the invention when considered in conjunction with the drawings.

DETAILED DESCRIPTION OF THE INVENTION

Figure 1:
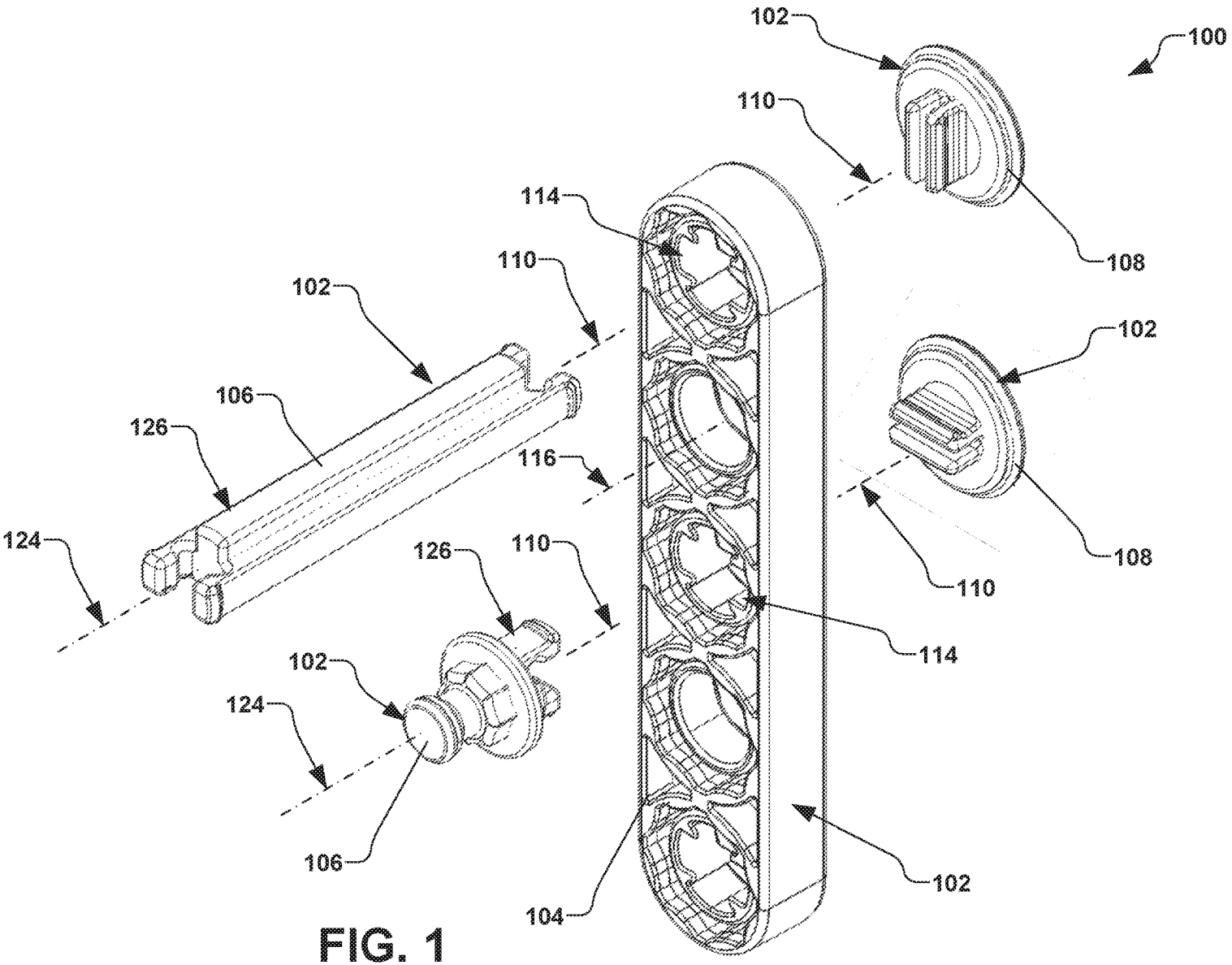
FIG. 1 is an exploded perspective view of an example snap-lock toy system in accordance with various example aspects of the disclosure.

The present disclosure relates to apparatuses and systems associated with construction toys. The construction toys of the present disclosure may utilize reusable snap-lock components and/or friction-fit components configured to enable a user to construct assemblies of various shapes and configurations. The present disclosure further provides a platform for assembling and creating a multitude of assemblies, whereby various electronic components may be further incorporated in and/or coupled to the platform.

Accordingly, the present invention will now be described with reference to the drawings, wherein like reference numerals may be used to refer to like elements throughout. It is to be understood that the description of these aspects are merely illustrative and that they should not be interpreted in a limiting sense. In the following description, for purposes of explanation, numerous specific details are set forth in order to provide a thorough understanding of the present invention. It will be evident to one skilled in the art, however, that the present invention may be practiced without these specific details. Further, the scope of the invention is not intended to be limited by the embodiments or examples described hereinafter with reference to the accompanying drawings, but is intended to be only limited by the appended claims and equivalents thereof.

It is also noted that the drawings are provided to give an illustration of some aspects of embodiments of the present disclosure and therefore are to be regarded as schematic only. In particular, the elements shown in the drawings are not necessarily to scale with each other, and the placement of various elements in the drawings is chosen to provide a clear understanding of the respective embodiment and is not to be construed as necessarily being a representation of the actual relative locations of the various components in implementations according to an embodiment of the invention. Furthermore, the features of the various embodiments and examples described herein may be combined with each other unless specifically noted otherwise.

It is also to be understood that in the following description, any direct connection or coupling between functional blocks, devices, components, circuit elements or other physical or functional units shown in the drawings or described herein could also be implemented by an indirect connection or coupling. Furthermore, it is to be appreciated that functional blocks or units shown in the drawings may be implemented as separate features or circuits in one embodiment, and may also or alternatively be fully or partially implemented in a common feature or circuit in another embodiment.

It should be noted that various features of the present disclosure, for example, may be configured to be utilized with, interconnect with, and/or operably couple to various other construction toy systems and apparatuses, such as those provided in commonly-owned U.S. Utility Pat. Nos. 8,651,914, 10,163,365, U.S. Design Pat. Nos. D612,435, D812,151, D825,678, and U.S. Patent Publication Numbers 2017/0109802, 2017/0209801, the contents of which are incorporated by reference herein, in their entireties. Further, various snap-lock components and systems can be configured for interconnection with the various systems and apparatuses of the present disclosure, such as those disclosed in co-owned U.S. patent application Ser. Nos. 29/721,603, 29/721,621, 29/721,602, 29/721,600, 29/721,720, 29/721,641, and 29/721,605, the contents of which are incorporated by reference, in their entireties.

Referring now to the Figures, in order to provide an overview and in accordance with one aspect of the disclosure, an example snap-lock toy system 100 is provided, wherein the snap-lock toy comprises a plurality of snap-lock toy members 102. The snap-lock toy members 102, for example, comprise any number of members, and it shall be understood that the examples provided herein are not limiting, but rather, are simplified examples for gaining a better understanding of the invention.

Figure 2:
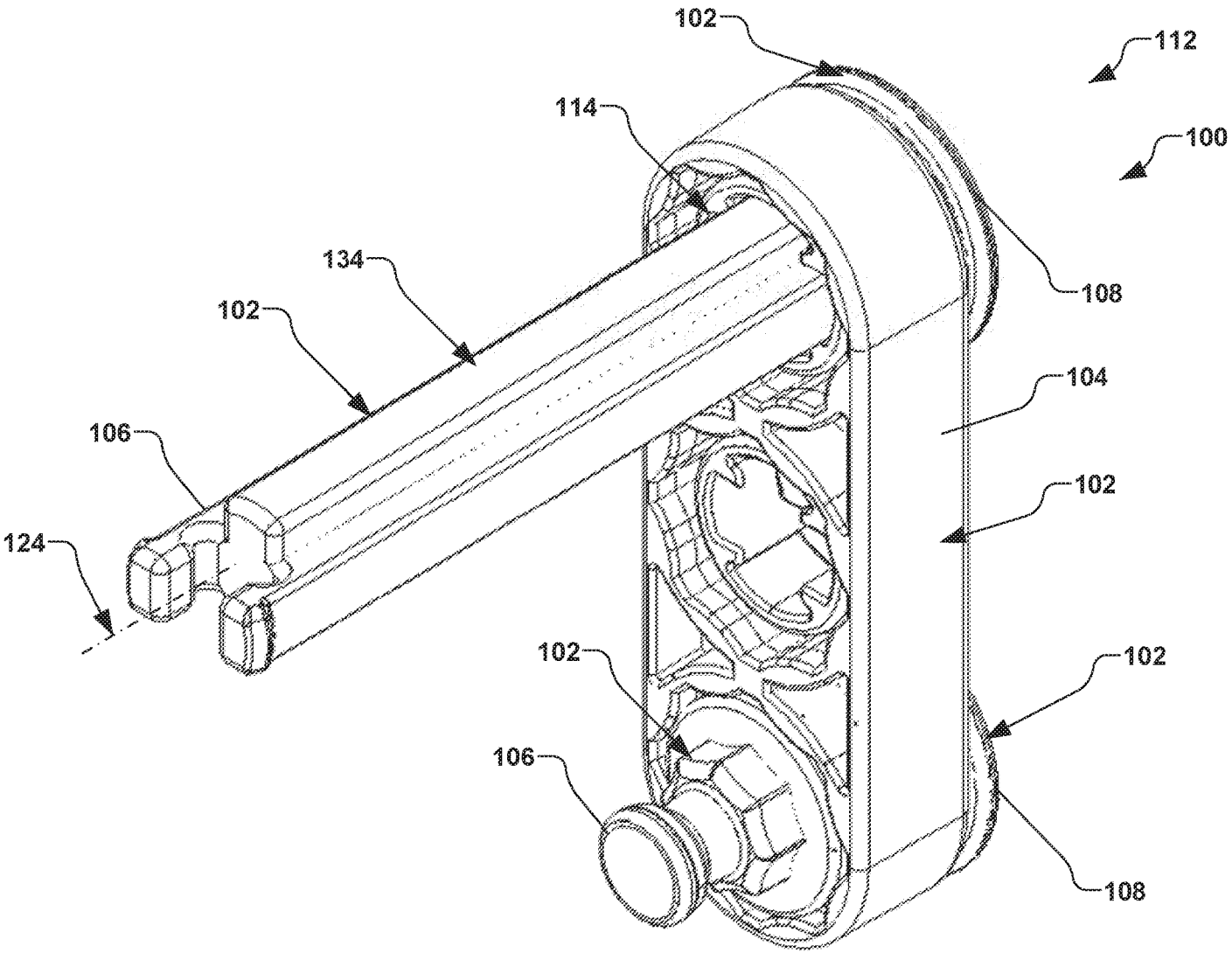
FIG. 2 is a perspective view of an example assembled snap-lock toy system in accordance with various example aspects of the disclosure.

As illustrated in FIG. 1, the snap-lock toy system 100 comprises various examples of a receiving member 104, a rod member 106, and a locking member 108, whereby the various snap-lock toy members 102 are configured to be interconnected (e.g., shown as lines 110 in FIG. 1) in a multitude of various ways. FIG. 2, for example, illustrates the interconnection of the various snap-lock toy members 102 of FIG. 1 in an assembled view 112. It should be noted that, while illustrated in various differing examples in the Figures, the terms receiving member 104, rod member 106, and locking member 108 as well as various individual features, thereof, will be discussed generally with similar reference numbers, whereby the use of such reference numbers is not to be taken in a limiting sense.

Figure 3:
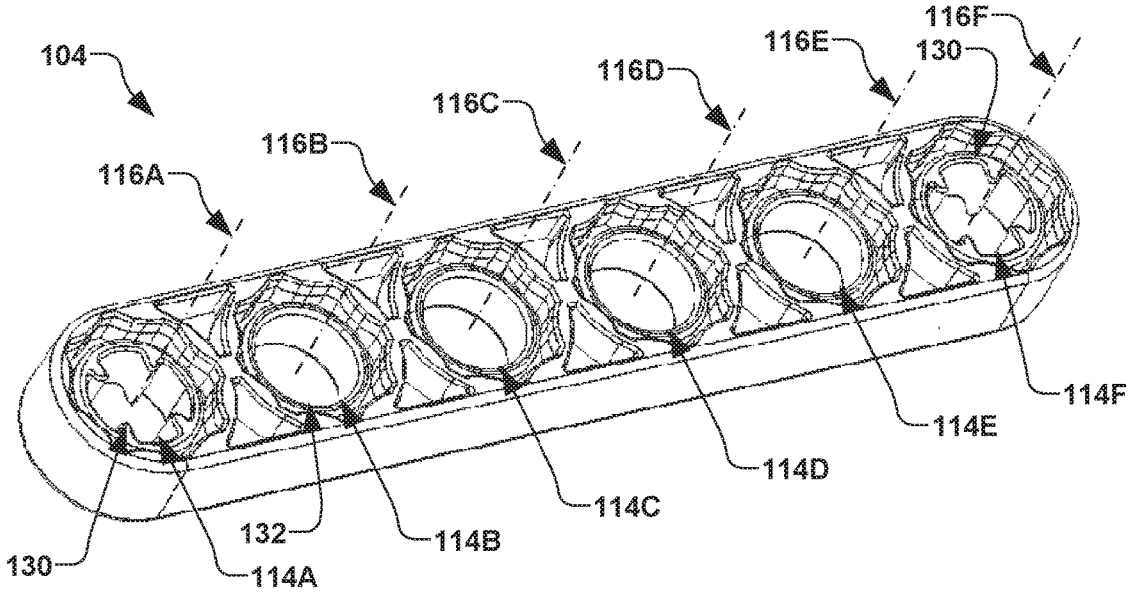
FIG. 3 is a perspective view of an example receiving member in accordance with various example aspects of the disclosure.
Figure 4:
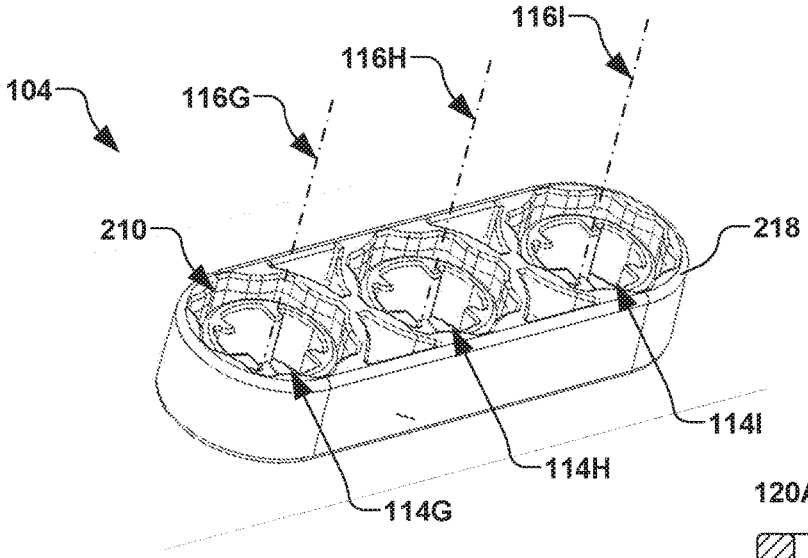
FIG. 4 is a perspective view of another example receiving member in accordance with various example aspects of the disclosure.

FIG. 3, for example, illustrates another example of the receiving member 104, wherein the receiving member comprises one or more thru-holes 114A-114F extending along one or more first axes 116A-116F. It is likewise noted that the present disclosure is not to be limited by the number or configuration of the one or more thru-holes 114, nor any particular shape thereof nor of the receiving member 104, as any shape is contemplated. For example, another receiving member 104 contemplated by the present disclosure is provided in FIG. 4, wherein the receiving member comprises three thru-holes 114G-114I extending along three first axes 116G-116I. While the receiving members 104 illustrated in FIGS. 3-4 are generally straight with rounded ends 118, it is to be understood that bent shapes, such as elbow-shaped, circular-shaped, or any other shape or size is contemplated as falling within the scope of the present disclosure.

Figure 5:
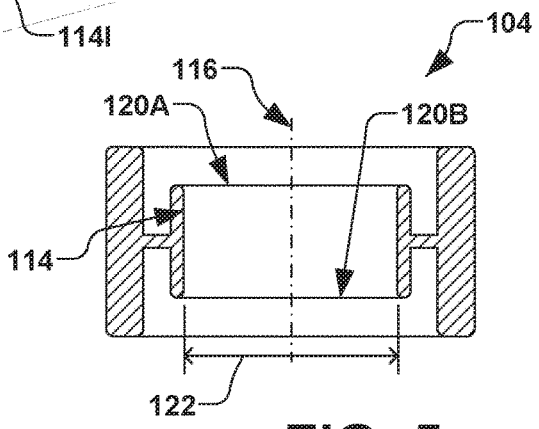
FIG. 5 is a simplified cross-sectional view of an example receiving member in accordance with various example aspects of the disclosure.

In order to gain a better understanding of the present invention, FIG. 5 illustrates a simplified cross-section of the receiving member 104, wherein the thru-hole 114 is illustrated as extending between a first hole end 120A and a second hole end 1208. The thru-hole 114, for example, defines a thru-hole dimension 122 between the first hole end 120A and second hole end 1208 when viewed along the first axis 116.

Figure 6:
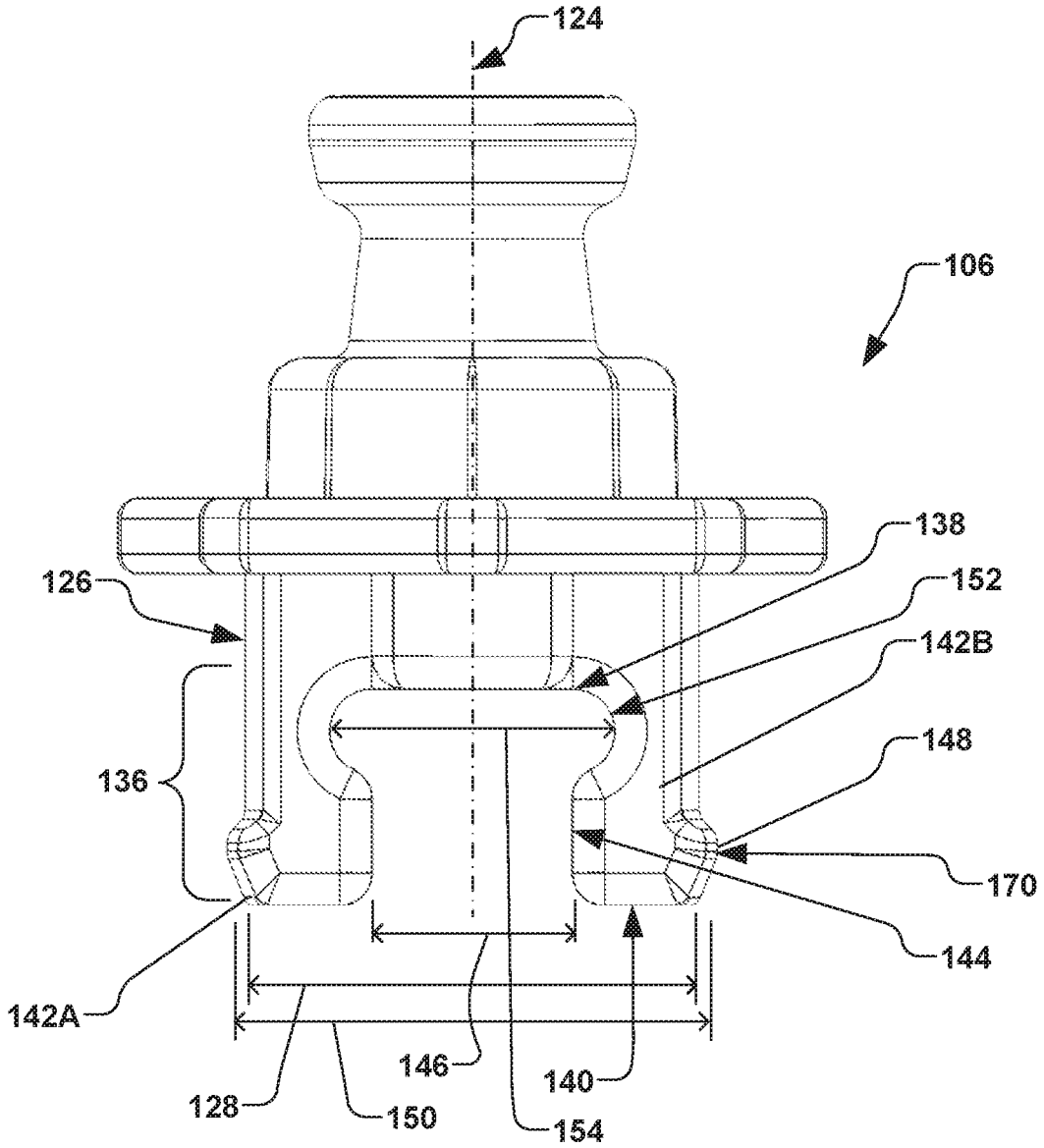
FIG. 6 is a side view of an example rod member in accordance with various example aspects of the disclosure.

Referring again to FIG. 1, the rod member 106, for example, extends along a second axis 124, wherein the rod member comprises an engagement portion 126 configured to selectively mate with the thru-hole 114. The engagement portion 126, as illustrated in FIG. 6, for example, generally defines an engagement dimension 128 when viewed along the second axis 124, wherein the engagement dimension is less than or approximately equal to the thru-hole dimension 122 of FIG. 5.

The thru-hole 114 of the receiving member 104 and engagement portion 126 of the rod member 106, for example, can be one or more of circular, cross-shaped, or any other shape when viewed along the respective first axis 116 and second axis 124. For example, thru-hole 114A of FIG. 3 is illustrated as cross-shaped 130, while thru-hole 1148 is illustrated as being circular shaped 132. Likewise, the rod member 106 illustrated in FIG. 2, for example is illustrated as being cross-shaped 134. While not shown, the rod member 106 may be circular shaped to engage the thru-hole 1148 of FIG. 3 that is circular-shaped 132.

In an example where the engagement portion 126 of the rod member 106 is substantially cross-shaped 134 such as illustrated in FIG. 2, the thru-hole 114 for example, can also be substantially cross-shaped 130, wherein the selective mating of the engagement portion of the rod member with the thru-hole generally prevents a rotation of the rod member about the first axis 116, while generally permitting a sliding engagement of the rod member along the first axis.

In another example, where thru-hole 114B of FIG. 3 is substantially circular shaped 132, the selective mating of the engagement portion 126 of the rod member 106 with the thru-hole generally permits a rotation of the rod member about the first axis 116, regardless of the shape of the engagement portion.

In accordance with one example, the engagement portion 126 illustrated in FIG. 6 comprises a first bifurcated portion 136 extending from a first location 138 along the second axis 124 to a first end 140 of the rod member 106. The first bifurcated portion 136, for example, comprises a pair of first cantilever members 142A, 1428 separated by a first gap 144 defining a first gap dimension 146 when viewed along the second axis 124.

Each first cantilever member 142A, 142B, for example, comprises a hole engagement rib 148 extending outward relative to the second axis 124, therein defining an engagement rib dimension 150 of the first bifurcated portion 136. The engagement rib dimension 150, for example, is greater than the thru-hole dimension 122 of FIG. 5, wherein the hole engagement rib 148 is configured to resiliently compress the pair of first cantilever members 142A, 1428 toward one another concurrent with an insertion of the engagement portion 126 of the rod member 106 into the first hole end 120A of the thru-hole 114.

The configuration of the hole engagement rib 148 of FIG. 6 and thru-hole 114 of FIG. 5, for example, are further configured to resiliently decompress the pair of first cantilever members 142A, 1428 away from one another concurrent with the hole engagement rib exiting the second hole end 1208 of the thru-hole 114. As such, the rod member 106, for example, can be selectively coupled to and decoupled from the receiving member 104 by a predetermined force. The predetermined force, for example, can be controlled based on the material, thickness, or other properties of the pair of first cantilever members 142A, 142B of FIG. 6.

According to another aspect, each first cantilevered member 142A, 1428, for example, further comprises an internal groove 152 proximate to the first location 138, therein defining a groove dimension 154 proximate to the first location when viewed along the second axis 124. The groove dimension 154, for example, is greater than the first gap dimension 146 associated with the first gap 144.

Figure 7:
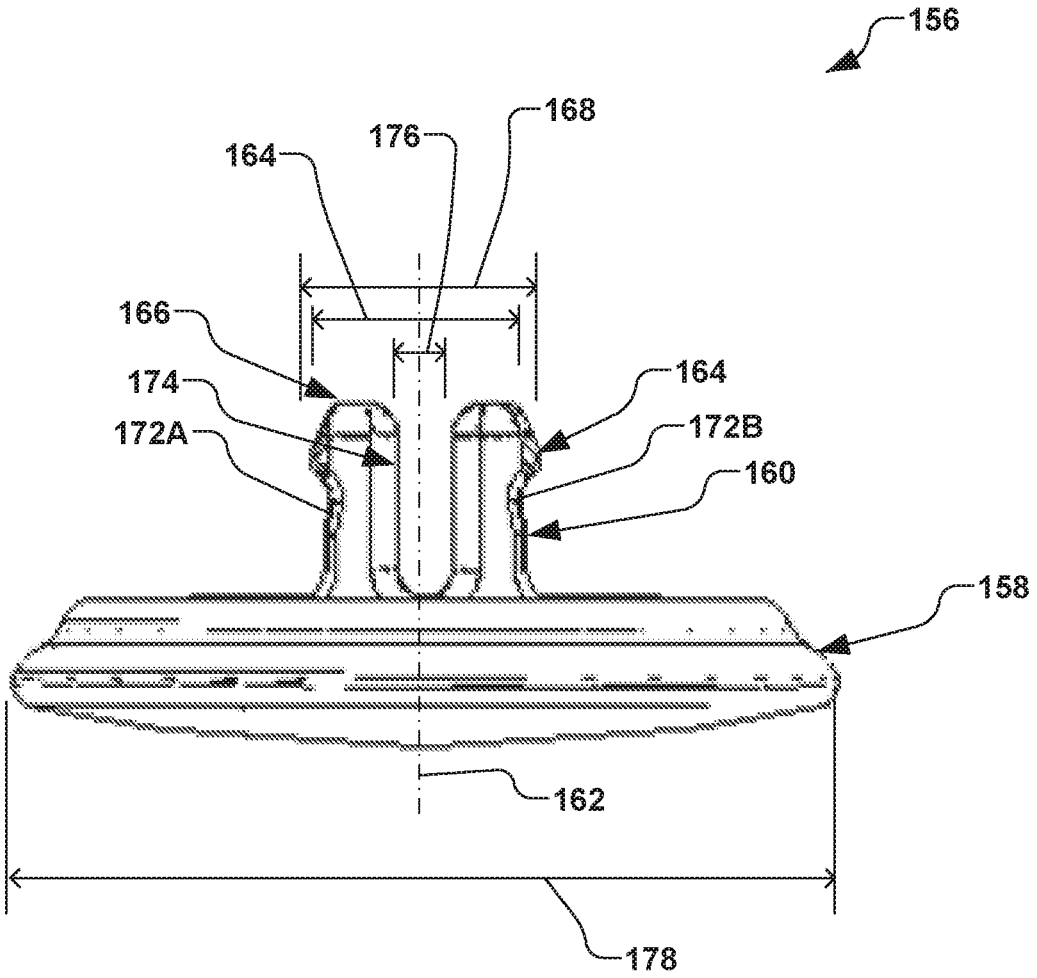
FIG. 7 is a side view of an example locking member in accordance with various example aspects of the disclosure.

In accordance with another aspect, as illustrated in FIG. 7, for example, a locking member 156 is further provided, and comprises a cap 158 and an interface portion 160 extending from the cap along a third axis 162. The interface portion 160, for example, is configured to selectively mate with the first bifurcated portion 136 of the rod member 106 of FIG. 6. The interface portion 160 of the cap 158, for example, defines an interface dimension 164 when viewed along the third axis 162, wherein the interface dimension is less than or approximately equal to the first gap dimension 146 shown in FIG. 6.

The locking member 156 of FIG. 7, for example, further comprises a locking rib 164 proximate to a distal end 166 of the interface portion 160. The locking rib 164, for example, extends outward relative to the third axis 162 (e.g., radially), therein defining a locking rib dimension 168. The locking rib dimension 168, for example, is greater than the first gap dimension 146 of FIG. 6, but less than or equal to the groove dimension 154, wherein the locking rib 164 of FIG. 7 is configured to resiliently compress concurrent with an insertion of the locking rib into the first bifurcated portion 136 of the rod member 106.

Further, the locking rib 164 of FIG. 7, for example, is configured to resiliently decompress concurrent with the locking rib engaging the internal groove 152 of the rod member 106 of FIG. 6. As such, a position 170 (e.g., a radial position with respect to the second axis 124) of the pair of first cantilever members 142A, 142B, for example, can be selectively fixed to substantially prevent decoupling of the rod member 106 from the receiving member 104.

In one example, the interface portion 160 of the locking member 156 is bifurcated, as illustrated in FIG. 7. In this example, the interface portion 156 comprises a pair of second cantilever members 172A, 172B that are separated by a second gap 174, thus defining a second gap dimension 176 therebetween. In this example, the pair of second cantilever members 172A, 172B provide the resiliency associated with the locking rib 164 discussed above.

In another example, the cap 158 illustrated in FIG. 7 generally defines a cap dimension 178 when viewed along the third axis 162, wherein the cap dimension is greater than the thru-hole dimension 122 of FIG. 5. Thus, the cap 158, for example, can be more easily coupled or decoupled from the rod member 106 of FIG. 6.

Figure 8:
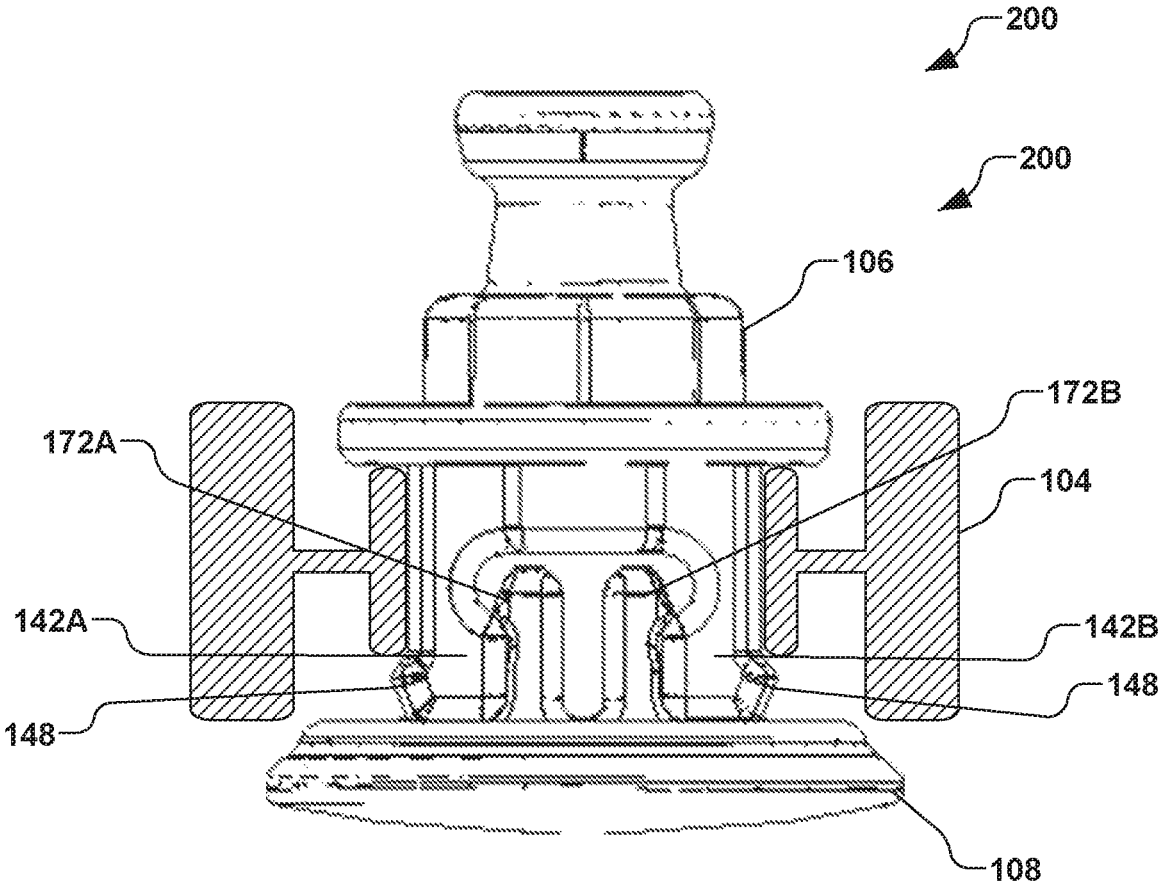
FIG. 8 is a simplified partial cross-sectional view of an example assembled snap-lock toy system in accordance with various example aspects of the disclosure.

FIG. 8 illustrates one example configuration 200 of the snap-lock toy system 100 comprising examples of the receiving member 104, rod member 106, and locking member 108 described above in a locked configuration 202, whereby the pair of second cantilever members 172A, 172B associated with the locking member substantially lock the pair of first cantilever members 142A, 142B in position, whereby the hole engagement rib 148 generally prevents the rod member from passing back through the second hole end 120B of the receiving member. By removing the locking member 108, for example, the pair of first cantilever members 142A, 142B would thus be permitted to flex, thus permitting easier removal of the rod member 106 from the receiving member 104.

Figure 9:
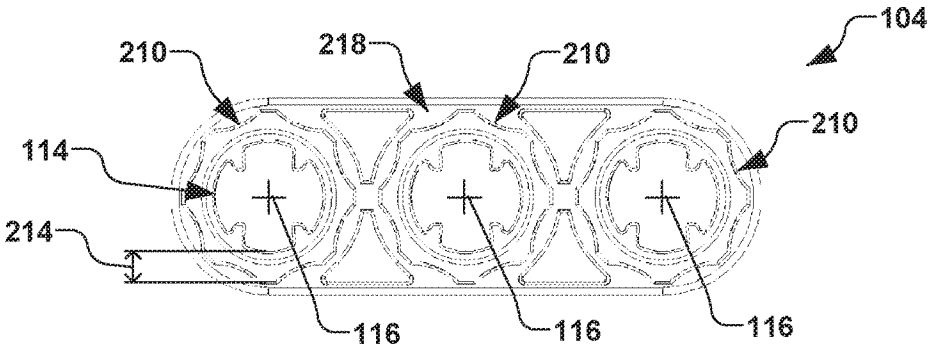
FIG. 9 is a plan view of the example receiving member of FIGS. 2 and 4 in accordance with various example aspects of the disclosure.

In still another aspect of the present disclosure, the receiving member 104 can further comprise one or more female receptors 210, as illustrated in FIG. 9, wherein each female receptor comprises a polygonal wall 212 defined around the thru-hole 114 when viewed along the first axis 116. The one or more female receptors 210, for example, respectively extend outward from one or more of the first and second hole ends 120A, 1208 of FIG. 5 of the thru-hole 114, for example, by a respective one or more female receptor depths 214 illustrated in FIG. 9.

Figure 11:
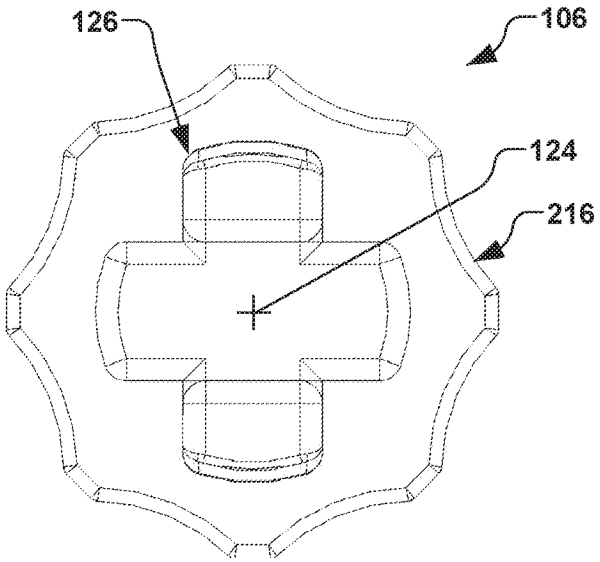
FIG. 11 is a plan view of the example receiving member of FIG. 10 in accordance with various example aspects of the disclosure.
Figure 10:
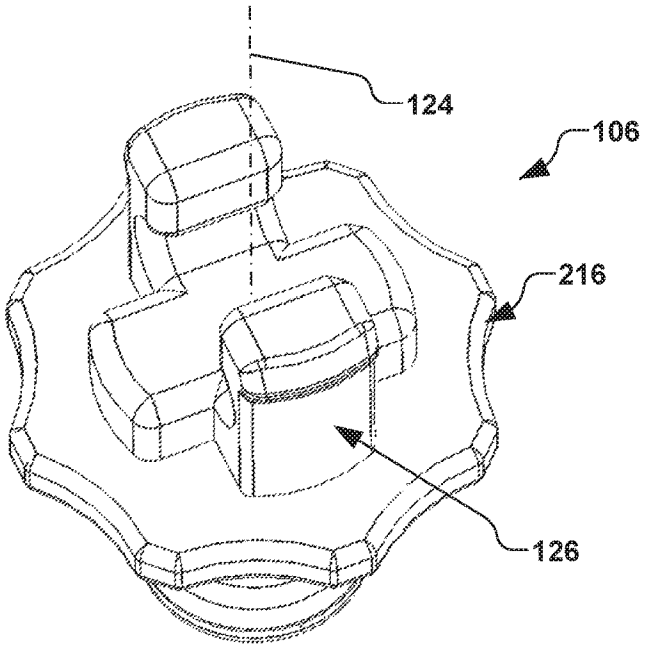
FIG. 10 is a perspective view of an example receiving member in accordance with various example aspects of the disclosure.

For example, the rod member 106 illustrated in FIGS. 10-11 can further comprise a polygonal feature 216 generally surrounding the engagement portion 126 when viewed along the second axis 124. The polygonal feature 216, for example, can be configured to selectively mate with the one or more female receptors 210 of the receiving member 104 of FIG. 8, therein selectively locking a rotational position of the rod member 106 with respect to the receiving member. The polygonal wall 212 of FIG. 8 and polygonal feature 216 of FIGS. 10-11, for example, can be substantially octagonal, thereby providing selective locking of the rotational position of the rod member 106 with respect to the receiving member 104 in 45-degree increments when viewed along the respective first axis 116.

In another example, the receiving member 104, such as shown in FIGS. 4 and 9, can comprise a support structure 218, wherein the thru-hole 114 and the one or more female receptors 210 are recessed from the support structure when viewed perpendicular to the first axis 116. In one example, such a recessing of the thru-hole 114 and the one or more female receptors 210 generally permits flush mounting of various other components or members (not shown) while permitting the rotational locking discussed above.

In yet another example, the receiving member 104 can comprise any number of thru-holes 114 in a myriad of configurations extending along a respective plurality of first axes 116, whereby the first axes need not be parallel. For example, the receiving member 104 can comprise a straight beam such as shown in FIG. 4, elbow beam (not shown), or any other beam having one, two, three, or more thru-holes defined therein, with any combination shapes of female receptors.

Figure 12:
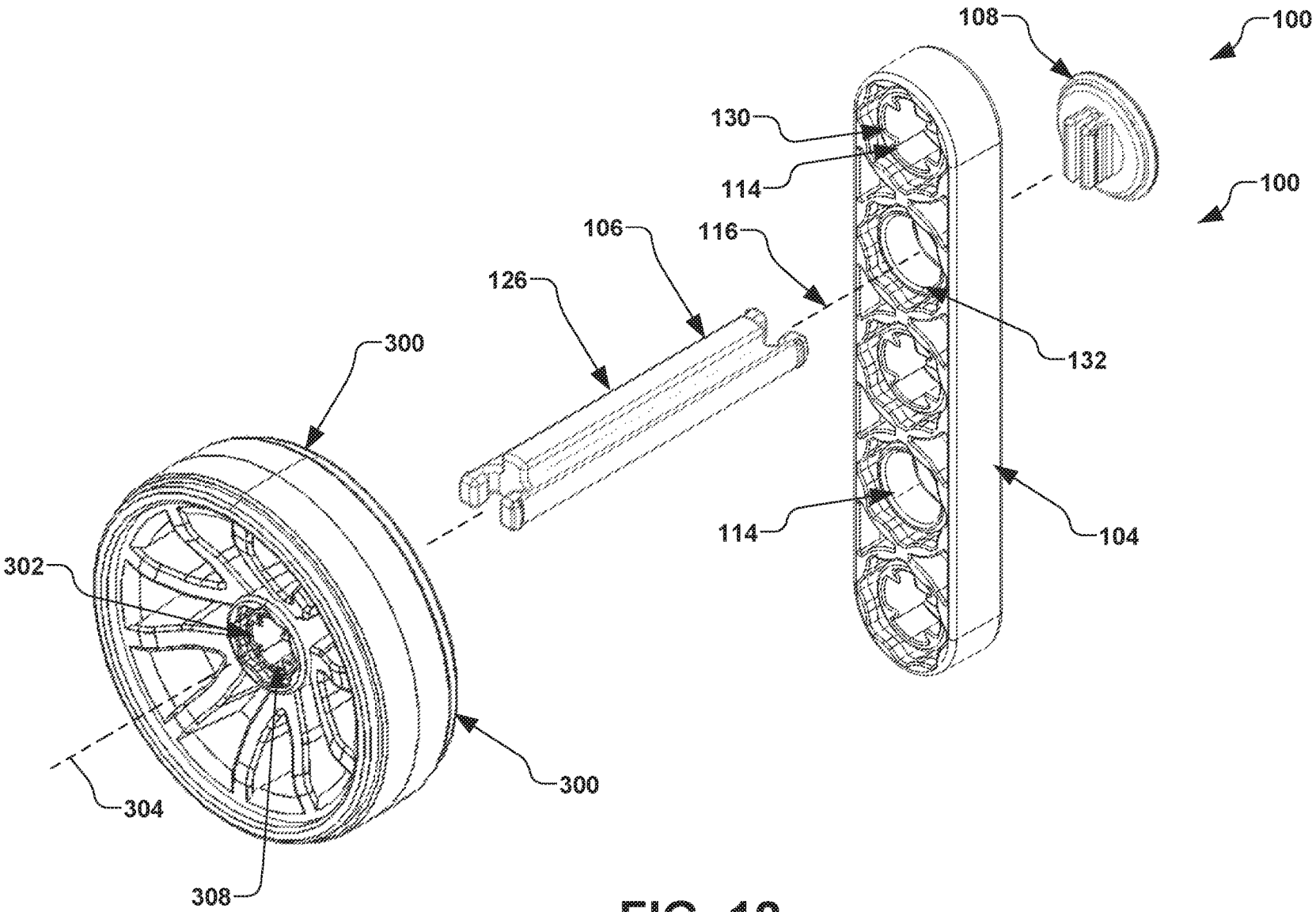
FIG. 12 is an exploded perspective view of another example snap-lock toy system in accordance with various example aspects of the disclosure.

According to another example of the present disclosure, FIG. 12 illustrates an example of an accessory member 300 that may be further provided in the snap-lock toy system 100. For example, the accessory member 300 can comprise an accessory hole 302 defined along a fourth axis 304. The accessory hole 302, for example, can be configured to further selectively mate with the engagement portion 126 of the rod member 106. The accessory member 300, for example, may comprise a wheel 306 as illustrated in FIG. 12, or it may comprise any number of other accessories, such as a gear, end piece, or various other accessories (not shown).

For example, the accessory hole 302 can be substantially cross-shaped 308 when viewed along the fourth axis 304, wherein when the thru-hole 114 in the receiving member 104 is substantially cross-shaped 130. As such, selective mating of the engagement portion 126 of the rod member 106 with the accessory hole 302 would generally prevent a rotation of the accessory member about the first axis 116 while generally permitting a sliding engagement of the accessory member 300 along the first axis.

In another example, the accessory hole 302 can be substantially circular-shaped 132 when viewed along the fourth axis 304, wherein when the thru-hole 114 in the receiving member 104 is substantially cross-shaped 130. As such, selective mating of the engagement portion 126 of the rod member 106 with the accessory hole 302 would generally permit a rotation of the accessory member about the first axis 116. Further, while not shown in FIG. 12, another locking member 108 may be coupled to the rod member 106 at the accessory hole 302, thereby locking the accessory member to the rod member.

In still another example, the accessory hole 302 can be substantially circular shaped (not shown) when viewed along the fourth axis 304, wherein the selective mating of the engagement portion 126 of the rod member 106 with the accessory hole generally permits a rotation of the accessory member 300 about the first axis 116.

In accordance with various other example aspects of the disclosure, a snap-lock toy is provided, wherein the snap-lock toy comprises a beam and at least one female receptor defined in the beam. The female receptor, for example, is generally defined by a substantially round hole having a first dimension and a polygonal outer wall having a second dimension, wherein the first dimension is less than the second dimension. The substantially round hole, for example, extends through a thickness of the beam. In one example, the polygonal outer wall is octagonal, but may have any number of sides.

In one example, the substantially round hole extends a first length through the beam, wherein the polygonal outer wall generally extends beyond the first length of the substantially round hole on one or more sides of the beam.

The substantially round hole, for example, extends a first length through the beam, wherein the polygonal outer wall generally extends beyond the first length of the substantially round hole on one or more sides of the beam. The polygonal outer wall may be spaced a predetermined distance from a center of the substantially round hole.

According to one example, the beam may comprise two or more female receptors. The beam may comprise a plurality of female receptors or connectors, and may be substantially linear or angled whereby the plurality of female receptors are aligned with respect to one another in a linear or angled manner.

The present disclosure, in another example, provides snap-lock toy system the beam and female receptor described above, whereby the beam and female connector may be selectively coupled to a male connector. The male connector, for example, comprises a first end and a second end. One or more of the first end and second end, for example, are configured to be selectively operably coupled to one or more of the substantially round hole and the polygonal outer wall. The first end of the male connector, for example, may comprise a bifurcated end, whereby the bifurcated end is configured to selectively secure the first end of the male connector to the substantially round hole.

The bifurcated end of the male connector, for example, comprises one or more lips at a distal end thereof, wherein the bifurcated end is configured to resiliently compress upon being passed through a first and of the substantially round hole, and wherein the one or more lips are configured to resiliently expand on exiting a second end of the substantially round hole, thereby selectively securing the first end of the male connector the female connector.

An engagement between the first end of the male connector and the substantially round hole, for example, may permit a rotation of the male connector with respect to the female connector. A locking pin, for example, may be further provided and configured to selectively engage the bifurcated end of the male connector, whereby the locking pin is configured to selectively prevent the rotation of the male connector with respect to the female connector.

The locking pin, for example, is designed to allow easy insertion in the slot of an axle (e.g., the female connector) and has snaps that click in the inside undercut of the axle slots. Once the locking pin is inserted, an external part or component such as gear, rod or wheel which is being supported by the axle, for example, becomes locked and generally cannot be removed unless the pin is first removed. One example reason is that the direction of movement to extract the axle from the part is aligned with the axle, which presses the snap tips of the axle inwards. This causes a vertical directional force to push on the base of wings of the locking pin. By pressing on the base where the wings of the pin are supported, the tips of the axle cannot deflect inwards and release the part. However, the part or component is removable if the locking pin is first removed by pulling the locking pin out (e.g., using an Engino extraction tool or a wedge). The locking pin is easily removable on its own due to the design of its wings that have a reversible snap fit at the undercut positioned in the inside of the slot of the tips of the axle.

A snap-lock toy is further provided comprising a body, an octagonal male feature extending from a surface of the body by a predetermined amount, and a female receptor generally centered inside the octagonal male feature. The octagonal male feature and the female receptor, for example, are configured to mate with a male rod having a generally square body and a male plug, wherein the interface between the octagonal male feature and the square body provide a plurality of 45 degree increments of rotation of the male rod with respect to the body.

The present disclosure contemplates various embodiments of the snap-lock toy construction members and systems described herein. For example, in a one example embodiment, a lock-pin mechanism is contemplated, such that the lock-pin mechanism selectively secures an axle to an exemplary vehicle, such that the locking mechanism (e.g., an interconnection between a locking member and a rod member) allows free rotation of the axle while also generally preventing the axle from decoupling from the vehicle when the locking mechanism is engaged (e.g., the locking member is engaged with the rod member as described infra). However, the present disclosure advantageously provides the locking member to be easily removed or disassembled, due to the snap-fit design discussed above, thus allowing the axle to be released and removed.

In another example embodiment, an axle-to-male plug connector is provided, whereby the engagement portion (e.g., a flange) of the rod member is one of a cylindrical or polygonal (e.g., octagonal) shape. The rod member, for example, may further comprise an accessory portion configured to interconnect to various other components, such as a male portion configured to connect the rod member to various blocks such as those made by Engino and discussed above. As such, the rod member of the present disclosure can be configured to connect with female features of conventional Engino blocks or beams, such that the present disclosure provides locking at predetermined angles (e.g. 45 degrees), or permits free rotation.

In another embodiment, the present disclosure provides axle-to-axle connections via a cylindrical or octagonal flange operably coupled to one or more of the receiving member (e.g., a beam) and rod member (e.g., an axle). As such, a connection between multiple beams, for example can be attained with locking at 45 degree increments, or free rotation with respect to one another. Longer axles and additional beams, for example, can thus be stacked one over the other by utilizing the presently disclosed engagement portion (e.g., flange) in between the components, such that a locked position or free rotation is possible.

Similarly, in another embodiment, beam connectors can be provided incorporating two or more axles positioned next to one another on a support plate, thus permitting two beams to connect inline or in various angles.

In another embodiment, a so-called half-rod is contemplated, whereby conventional Engino female end connections are provided with a half-size receiving member (e.g., beam) such that previous conventional blocks can interconnect with the apparatuses and systems of the present disclosure with the additional benefit of various angles and optional rotation and locking.

In another example embodiment, a so-called "GINO-BOT" robot is provided, whereby a cover plate or cabin is easily removable and re-positioned by embedding the various example geometries and embodiments disclosed herein.

Although the invention has been shown and described with respect to a certain embodiment or embodiments, it should be noted that the above-described embodiments serve only as examples for implementations of some embodiments of the present invention, and the application of the present invention is not restricted to these embodiments. In particular regard to the various functions performed by the above described components (assemblies, devices, circuits, etc.), the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention may have been disclosed with respect to only one of several embodiments, such feature may be combined with one or more other features of the other embodiments as may be desired and advantageous for any given or particular application. Accordingly, the present invention is not to be limited to the above-described embodiments, but is intended to be limited only by the appended claims and equivalents thereof.

What is claimed is:

1. A snap-lock toy system comprising:

a receiving member comprising a thru-hole extending along a first axis between first and second hole ends, wherein the thru-hole defines a thru-hole dimension when viewed along the first axis;

a rod member extending along a second axis, the rod member comprising an engagement portion configured to selectively mate with the thru-hole, wherein the engagement portion defines an engagement dimension when viewed along the second axis, wherein the engagement dimension is less than or approximately equal to the thru-hole dimension, and wherein the engagement portion comprises a first bifurcated portion extending from a first location along the second axis to a first end of the rod member, wherein the first bifurcated portion comprises a pair of first cantilever members separated by a first gap defining a first gap dimension when viewed along the second axis, wherein each first cantilever member comprises a hole engagement rib extending outward relative to the second axis, therein defining an engagement rib dimension of the first bifurcated portion wherein the engagement rib dimension is greater than the thru-hole dimension, wherein the hole engagement rib is configured to resiliently compress the pair of first cantilever members toward one another concurrent with an insertion of the engagement portion into the first hole end of the thru-hole and to resiliently decompress the pair of first cantilever members away from one another concurrent with exiting the second hole end of the thru-hole, therein selectively coupling the rod member to the receiving member, and wherein each first cantilevered member further comprises an internal groove proximate to the first location, therein defining a groove dimension proximate to the first location when viewed along the second axis, wherein the groove dimension is greater than the first gap dimension; and a locking member comprising a cap and an interface portion extending from the cap along a third axis, wherein the interface portion is configured to selectively mate with the first bifurcated portion of the rod member, wherein the interface portion defines an interface dimension when viewed along the third axis that is less than or approximately equal to the first gap dimension, and wherein the locking member further comprises a locking rib proximate to a distal end of the interface portion, wherein the locking rib extends outward from the interface portion relative to the third axis, therein defining a locking rib dimension, wherein the locking rib dimension is greater than the first gap dimension and less than or equal to the groove dimension, wherein the locking rib is configured to resiliently compress concurrent with an insertion of the locking rib into the first bifurcated portion of the rod member, and to resiliently decompress concurrent with the locking rib engaging the internal groove of the rod member, therein selectively fixing a radial position of the pair of first cantilever members to substantially prevent decoupling of the rod member from the receiving member.

2. The snap-lock toy system of claim 1, wherein the interface portion of the locking member is bifurcated, wherein the interface portion comprises a pair of second cantilever members separated by a second gap and defining a second gap dimension therebetween.

3. The snap-lock toy system of claim 1, wherein the engagement portion of the rod member is substantially cross-shaped when viewed along the second axis.

4. The snap-lock toy system of claim 3, wherein the thru-hole is substantially cross-shaped when viewed along the first axis, wherein the selective mating of the engagement portion of the rod member with the thru-hole generally prevents a rotation of the rod member about the first axis while generally permitting a sliding engagement of the rod member along the first axis.

5. The snap-lock toy system of claim 1, wherein the thru-hole is substantially circular when viewed along the first axis, wherein the selective mating of the engagement portion of the rod member with the thru-hole generally permits a rotation of the rod member about the first axis.

6. The snap-lock toy system of claim 1, wherein the cap generally defines a cap dimension, wherein the cap dimension is greater than the thru-hole dimension when viewed along the third axis.

7. The snap-lock toy system of claim 1, further comprising an accessory member, wherein the accessory member comprises an accessory hole defined along a fourth axis and configured to further selectively mate with the engagement portion of the rod member.

8. The snap-lock toy system of claim 7, wherein the thru-hole is substantially cross-shaped when viewed along the first axis, and wherein the accessory hole is substantially cross-shaped when viewed along the fourth axis, wherein the selective mating of the engagement portion of the rod member with the accessory hole generally prevents a rotation of the accessory member about the first axis while generally permitting a sliding engagement of the accessory member along the first axis.

9. The snap-lock toy system of claim 7, wherein the accessory hole is substantially circular when viewed along the fourth axis, wherein the selective mating of the engagement portion of the rod member with the accessory hole generally permits a rotation of the accessory member about the first axis.

10. The snap-lock toy system of claim 1, wherein the receiving member further comprises one or more female receptors, wherein each female receptor comprises a polygonal wall defined around the thru-hole when viewed along the first axis, wherein the one or more female receptors respectively extend outward from one or more of the first and second hole ends of the thru-hole by a respective one or more female receptor depths.

11. The snap-lock toy system of claim 10, wherein the rod member further comprises a polygonal feature generally surrounding the engagement portion when viewed along the second axis, wherein the polygonal feature is configured to selectively mate with the one or more female receptors of the receiving member, therein selectively locking a rotational position of the rod member with respect to the receiving member.

12. The snap-lock toy system of claim 11, wherein the polygonal wall and polygonal feature are substantially octagonal, thereby providing selective locking of the rotational position of the rod member with respect to the receiving member in 45-degree increments when viewed along to the first axis.

13. The snap-lock toy system of claim 10, wherein the receiving member comprises a support structure, wherein the thru-hole and the one or more female receptors are recessed from the support structure when viewed perpendicular to the first axis.

14. The snap-lock toy system of claim 1, wherein the receiving member comprises a plurality of thru-holes extending along a respective plurality of first axes.

15. A snap-lock toy system comprising:

a receiving member comprising a thru-hole along a first axis;

a rod member comprising an engagement portion along a second axis and configured to selectively mate with the thru-hole, wherein the engagement portion comprises a pair of first cantilever members separated by a first gap, wherein each first cantilever member comprises a hole engagement rib configured to resiliently compress the pair of first cantilever members toward one another concurrent with an insertion of the engagement portion into a first hole end of the thru-hole and to resiliently decompress the pair of first cantilever members away from one another concurrent with exiting a second hole end of the thru-hole, therein selectively coupling the rod member to the receiving member by a friction interface between the pair of first cantilever members and the thru-hole along the first and second axes, and wherein each first cantilevered member further comprises an internal groove; and a locking member comprising a cap and an interface portion along a third axis having a locking rib extending radially therefrom, wherein the interface portion is configured to selectively mate with the pair of first cantilever members, wherein the locking rib is configured to resiliently compress concurrent with an insertion of the locking rib between the pair of first cantilever members, and to resiliently decompress concurrent with the locking rib engaging the internal groove, therein selectively fixing a radial position of the pair of first cantilever members and the hole engagement rib to substantially prevent decoupling of the rod member from the receiving member along the first, second, and third axes.

16. The snap-lock toy system of claim 15, wherein the interface portion of the locking member is bifurcated, wherein the interface portion comprises a pair of second cantilever members separated by a second gap.

17. The snap-lock toy system of claim 15, wherein the engagement portion of the rod member is substantially cross-shaped when viewed along the second axis.

18. The snap-lock toy system of claim 17, wherein the thru-hole is substantially cross-shaped when viewed along the first axis, wherein the selective mating of the engagement portion of the rod member with the thru-hole generally prevents a rotation of the rod member about the first axis while generally permitting a sliding engagement of the rod member along the first axis.

19. The snap-lock toy system of claim 15, wherein the thru-hole is substantially circular when viewed along the first axis, wherein the selective mating of the engagement portion of the rod member with the thru-hole generally permits a rotation of the rod member about the first axis.

20. The snap-lock toy system of claim 15, wherein the receiving member further comprises one or more female receptors, wherein each female receptor comprises a polygonal wall defined around the thru-hole when viewed along the first axis, wherein the one or more female receptors respectively extend outward from one or more of the first and second hole ends of the thru-hole, and wherein the rod member further comprises a polygonal feature generally surrounding the engagement portion when viewed along the second axis, wherein the polygonal feature is configured to selectively mate with the one or more female receptors of the receiving member, therein selectively locking a rotational position of the rod member with respect to the receiving member.

* * * * *